US005862568A

United States Patent [19]

Sjöberg

[11] Patent Number: 5,862,568

[45] Date of Patent: Jan. 26, 1999

[54] CLEANING APPARATUS

[76] Inventor: Jonas Sjöberg, Våaghalsvägen 23, S-771 94, Ludvika, Sweden

[21] Appl. No.: 860,138

[22] PCT Filed: Jul. 15, 1996

[86] PCT No.: PCT/SE96/00958

§ 371 Date: Jun. 11, 1997

§ 102(e) Date: Jun. 11, 1997

[87] PCT Pub. No.: WO97/03767

PCT Pub. Date: Feb. 6, 1997

[30] Foreign Application Priority Data

Jul. 19, 1995 [SE] Sweden ..... 9502658

[51] Int. Cl.[6] ..... B08B 9/00

[52] U.S. Cl. ..... 15/304; 15/104.12; 15/406; 134/167 C

[58] Field of Search ..... 15/104.05, 104.09, 15/104.12, 104.31, 395, 304, 406; 134/167 C, 168 C

[56] References Cited

U.S. PATENT DOCUMENTS

| | | | |
|---|---|---|---|
| 4,206,313 | 6/1980 | Cavoretto . | |
| 4,718,142 | 1/1988 | Wahlers | 15/406 |
| 4,984,329 | 1/1991 | Wade | 15/395 |
| 4,995,201 | 2/1991 | Von Borcke et al. | 134/167 C |
| 5,143,105 | 9/1992 | Katayama | 134/167 C |
| 5,179,753 | 1/1993 | Flaherty et al. | 15/104.12 |
| 5,383,975 | 1/1995 | Faxon | 15/304 |
| 5,428,862 | 7/1995 | Sailer | 15/304 |
| 5,745,948 | 5/1998 | Lloyd | 15/104.12 |

FOREIGN PATENT DOCUMENTS

| | | |
|---|---|---|
| WO90/12662 | 11/1990 | WIPO . |
| WO92/05888 | 4/1992 | WIPO . |
| WO95/00262 | 1/1995 | WIPO . |

*Primary Examiner*—Terrence Till
*Attorney, Agent, or Firm*—Fasth Law Offices; Rolf Fasth

[57] ABSTRACT

The cleaning apparatus is for cleaning pipes and ducts and comprises a housing having a first end and a second end. A connection for a pressure medium is disposed at the first end and a cleaning member is disposed at the second end of the housing. A chamber is defined in the housing and contains the pressure medium. A drive member is located inside the housing and adapted to rotate the cleaning member. Nozzle openings are defined by the housing and connected with the chamber and a surface of the housing to permit the housing to propel along a duct. A shaft having one end secured to the drive member is rotatably disposed in the housing and adapted to carry the cleaning member at an end that is opposite to the end secured to the drive member.

12 Claims, 3 Drawing Sheets

II–II

CLEANING APPARATUS

TECHNICAL FIELD

The present invention generally relates to the cleaning or clearing of pipes and channels, such as ventilation ducts, by means of a cleaning apparatus that, driven by a pressure medium is brought to move inside such a pipe or channel and to perform its cleaning function.

BACKGROUND AND BRIEF SUMMARY OF THE INVENTION

Apparatuses of the above indicated, general kind are known through for instance Swedish patents Nos. 500 894 and 500 428. These known apparatuses which are those which are presently mainly used for cleaning ventilation ducts and the like, and although they in many cases operate satisfactorily they suffer from a great number of relatively serious shortcomings. A very serious disadvantage of these known apparatuses is that their design results in a very high consumption of air and that they therefore require compressors having high capacity and a correspondingly high price. In the case of the first-mentioned one of the known apparatuses the high consumption of air depends mainly on the fact that the pressure medium while being the driving or propelling medium for the apparatus also all by itself performs the cleaning function, and as regards the last-mentioned one of the known apparatuses this is originally and intentionally, designed for a large pressure medium flow of up to 6.3 $m^3$/min.

Other shortcomings of the known apparatuses is that they have problems engaging the wall of the channel during operation, which in both cases must be solved by means of some kind of auxiliary friction means on the apparatus for increasing the friction against the channel wall; that they have a tendency to turn in the channel during operation due to the fact that the pressure medium exhaust openings are provided on a sidewall of the housing of the apparatus and are directed obliquely backwards towards the channel wall; and that they, due to their design as an "outer turbine", i.e. in both cases one portion of the housing of the apparatus is in practice designed as the turbine rotor, while another portion of the housing is designed as an inner turbine housing, experience bearing problems in the bearing between the inner turbine housing and the rotor, said problems being caused by to the heavy impacts against the channel wall which may occur due to unbalance and the relatively great moment developed which such a design as an "outer turbine".

A basic object of the present invention is therefore to provide an apparatus of the kind indicated in the introduction, which eliminates or at least substantially reduces the above discussed problems in connection with the prior art apparatuses, and which more specifically presents better performance and reliability combined with low air consumption and simple manufacturing.

BRIEF DESCRIPTION OF THE DRAWINGS

The invention and its basic principles and specific advantages and features are explained more closely below with reference to the enclosed schematic drawings which illustrate an embodiment of the cleaning apparatus according to the invention. In the drawings.

DETAILED DESCRIPTION

Figure 1:
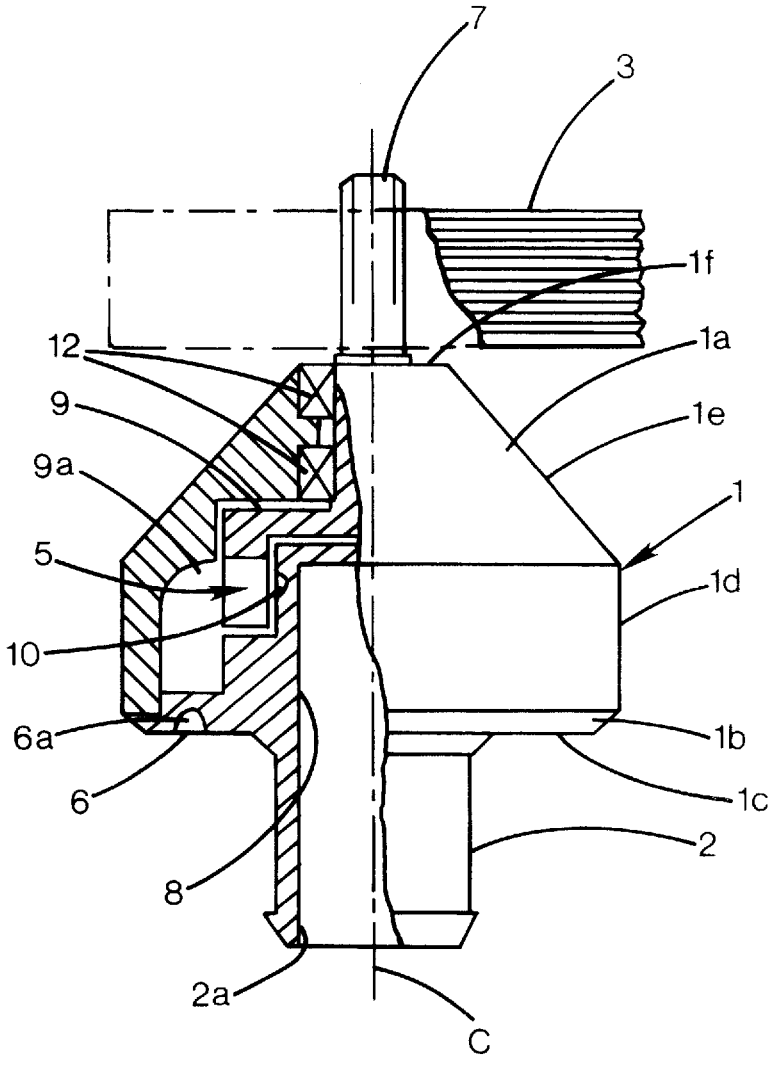
FIG. 1 illustrates a partially sectioned side view of an embodiment of the cleaning apparatus according to the invention.

As illustrated in FIG. 1 the cleaning apparatus according to the invention basically consists of a housing 1 which in the illustrated embodiment consists of a forward portion 1*a* and a rearward portion 1*b*, whereby the terms "forward" and "rearward" respectively refer to the driving or propelling direction of the apparatus in the pipe or duct to be cleaned (not illustrated). This general design in the shape of a housing consisting of two parts corresponds to that of the known apparatuses according to the Swedish patents Nos. 500 894 and 500 428 mentioned in the introduction. However, a characterizing feature of the apparatus according to the invention is that the two housing parts 1*a* and 1*b* are firmly connected to each other so as to not rotate mutually, and they may for instance be welded together, screwed together or glued together, whereas the housing parts according to the known apparatuses are rotatable relative to each other, and the meaning of this basic difference will be explained more closely below.

Figure 2B:
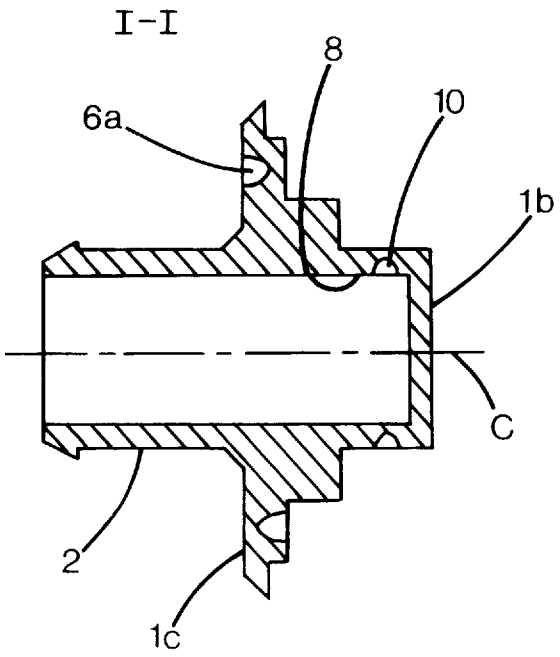
FIG. 2*b* is a longitudinal section along line I—I, of the rear housing portion of FIG. 2*a*.
Figure 2A:
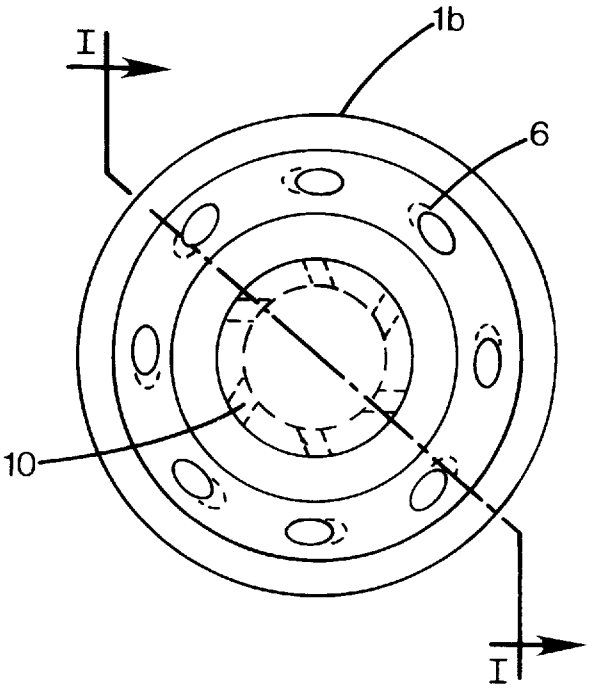
FIG. 2*a* illustrates an end view of the forward, in FIG. 1 upper, end of the rear housing portion of the cleaning apparatus of FIG. 1.
Figure 3A:
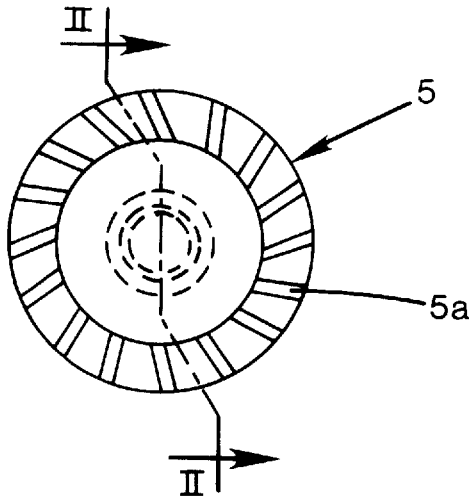
FIG. 3*a* is an end view from below of the drive means of the cleaning apparatus according to FIG. 1
Figure 3B:
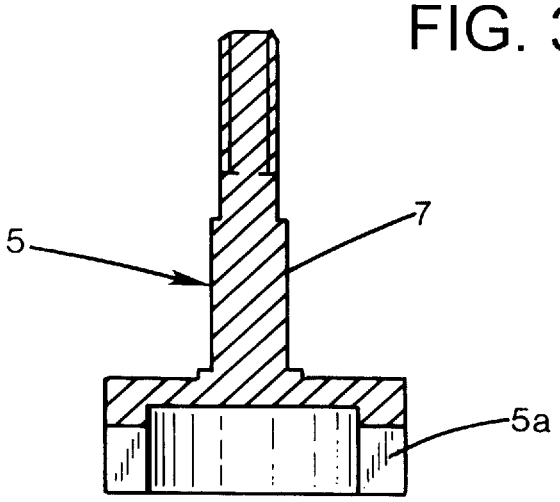
FIG. 3*b* illustrates a side view along line II—II in FIG. 3A of the inner drive means of the cleaning apparatus according to FIG. 1.

At its rear end the rearward housing part 1*b* is provided with a connection 2 for connecting a pressure medium to the apparatus, and this connection 2 may be firmly attached to the housing part 1*b* but is preferably integral with the latter, such as in the embodiment according to FIG. 1. At its rear end the rearward housing part 1*b* is provided with a substantially planar rear end surface 1*c* which is provided substantially at a right angle to the centre axis C of the apparatus, and in this rear end surface 1*c* are provided a suitable number, in the illustrated embodiment eight, of nozzles or exhaust openings 6 which are evenly distributed around the annular end surface 1*c* and through which the pressure medium supplied through the connection 2 flow out from the apparatus again. These exhaust openings 6 and their function will be explained more closely below. The inner through-bore 2*a* of the connection 2 passes into an inlet channel 8 in the rearward housing part 1*c*, said inlet channel 8 having a corresponding dimension. The inlet channel 8 is closed at its axially forward end but communicates with an inner chamber 9 formed between the housing parts 1*a* and 1*b* through passages or flow channels 10 (illustrated partly in FIGS. 1 and 2*a* and indicated in FIG. 2*b*) which are evenly distributed around the inner wall of the channel 8 at a small distance from the closed end thereof.

In the inner chamber 9 a turbine wheel or a rotor 5 is rotatably received with its vanes 5*a* provided on the same level as the flow passages 10. The rotor 5 is carried by a shaft 7 which for reasons related to the technique of manufacturing is preferably, as in the illustrated embodiment, integral with the rotor 5 but which may also consist of a separate part connected to the rotor. The shaft 7 is journalled in the forward housing part 1*a* by means of double, axially separated bearings 12, preferably ball bearings, whereby bearing forces may be carried in an advantageous manner at the same time as the shaft may be made thicker for greater strength. The shaft 7 is manufactured having such a length that it protrudes past the front end surface of the forward housing 1*a* a distance adequate for mounting a cleaning means 3, preferably a cleaning brush, on the outer free end thereof. In an extension 9*a* of the inner chamber, outside the rotor 11, the pressure medium flowing substantially radially through the rotor 11 is conducted back in order to flow substantially axially through outlet channels 6*a* and out from the rear end surface 1*c* of the rearward housing part 1*b* through the outlet openings 6, for propelling the apparatus through a pipe or duct.

In the area where it passes on to the rearward housing part 1*b* the forward housing part 1*a* is provided with an annular, continuous side surface id which passes on to a front surface 1*e* tapering conically in a forward direction and terminating at a front end surface 1*f* positioned at a right angle to the centre axis C. The above described apparatus operates in the following manner. The pressure medium supplied through a hose (not shown) connected to the connection 2 enters the inlet channel 8 and is by its closed end conducted out through the flow channels 10 so that it flows substantially radially through the turbine wheel or rotor 5. Thereby the rotor 5 is rotated and this rotation is transmitted to the cleaning brush 3 while both the forward housing part 1*a* and the rearward housing part 1*b* stand still with respect to a rotation around the centre axis C. The cleaning brush 3 should have an outer diameter exceeding that of the housing 1 and may within certain limits be given an optional length in the axial direction of the housing. The maximum length of the brush 3 is in practice obviously determined by the length of the portion of the shaft 7 protruding from the housing. Through its rotation the cleaning brush does furthermore fulfill the double function of on the one hand brushing off contamination from the inner wall of the duct or pipe and of on the other hand, bringing the entire apparatus to move in a path around the inner periphery of the pipe or duct, for effectively cleaning each surface thereof. As the pressure medium leaves the rotor it is conducted through the outer portion 9*a* of the inner chamber 9 and backwards in an axial flow in a direction opposite that of the delivery or feed, and flows out from the rear end surface 1*c* of the rearward housing part 1*b* through the outlet channels 6*a* opening in the outlet openings 6. Thus, the apparatus is propelled axially in the duct or pipe through the jet propulsion principle, and more specifically the apparatus is usually employed such that it is initially allowed to move a desired distance into the duct, whereupon it is pulled back in the duct by means of the pressure medium hose while the entire apparatus performs a helical movement around the inner wall of the pipe or duct as it is pulled back therein.

As indicated above the basic feature of the invention is that the cleaning apparatus is manufactured having a housing which is operatively or functionally an integral unit although it consists of two housing parts firmly connected to each other, and which encloses a rotatable drive means, preferably in the shape of of an inner turbine wheel or rotor. With this design suggested according to the invention vital advantages are achieved in relation to earlier known apparatuses of this kind, and more specifically a cleaning apparatus is provided which has clearly better performance, reliability and durability while the air consumption is markedly lower, its the contact being at least comparable without the employment of auxiliary friction means and the manufacturing thereof being comparatively simple and inexpensive. As regards performance/air consumption the operation achieved by means of the design suggested according to the invention is at least as good as for i.e. the apparatus according to the above mentioned Swedish patent 500 428 at an air consumption of approximately 1.5 $m^3$/min., to be compared with an air consumption in the range of 4.5 $m^3$/min. for the known apparatus.

The reliability and durability of the cleaning apparatus according to the invention is significantly increased as compared to the known cleaning apparatuses, predominantly in view of the fact that an inner rotor having a certain, correctly adapted fly wheel presents a much lower bearing load since only uneven loads from the brush effects the same. According to a further development of the invention there are also provided double, axially separated ball bearings which means that the bearing forces may be carried even better while the shaft may be made heavier, having greater strength. In contrast to this the known apparatuses having an outer rotor suffer from problems such as imbalance resulting in bearing forces. This imbalance very often arises since the turbines designed in this manner easily collide with the walls of the duct.

The apparatus according to the invention has a much calmer operation or action in the duct than the known apparatuses, i.e. it does not have the same tendency to heavy impacts against the wall of the duct, and for this reason it may be manufactured from aluminum, possibly with some surface treatment, while the known apparatuses on the other hand should be manufactured from for instance titanium in order to withstand the strain or stress.

In a further development of the apparatus according to the invention it is suggested, according to another aspect thereof, that the outlet or nozzle openings 6 are directed substantially straight backwards, i.e. that they are provided in a rear end surface of the housing which is directed substantially at a right angle to the centre axis of the apparatus, and are not provided in a side surface of the housing and directed obliquely upwardly/backwardly against the duct wall, such as is the case of the known apparatuses. With these outlet openings directed substantially straight backwardly, as suggested according to the invention, the risk of the cleaning apparatus turning in the pipe or duct, as is the case with said known apparatuses, is completely eliminated. This design, with the outlet openings positioned in the rear end wall, also improves the bearing or contact and provides a great tractive force or propulsion, especially with a high outlet speed. The further development of the invention providing the further improved contact or bearing permits a complete elimination of the friction rings of the known apparatuses, and instead a larger brush may be employed. A further improvement of the contact or bearing is achieved if the rotational speed of the turbine is deliberately made high.

In view of what has been described above it is therefore obvious that the cleaning apparatus as suggested according to the invention well fulfills the objects indicated in the introduction.

Although the invention has been described above with specific reference to an illustrated embodiment thereof it should be obvious that the invention is not restricted to the described embodiment but that the invention likewise comprises the modifications and variations thereof which are obvious to a man skilled in the art. Furthermore it should be emphasized that the above description does not contain any more direct specifications regarding details of the flow paths of the pressure medium and that this is deliberate since such specifications may be varied for each separate application in order to obtain a desired adjustment or balance between parameters such as rotational speed of the turbine wheel, tractive force of the apparatus, etc. Thus, the area and alignment of the flow channels 10 may for instance be varied in cooperation with the design of the turbine vanes or blades, such as their length, angle and whether or not they are straight or curved. In the illustrated embodiment the turbine rotor is manufactured having straight vanes the extension of which is a tangent to a circle having its centre in the centre axis of the rotor and cooperating with flow channels 10 which likewise are tangents to an inner circle having its centre in the centre axis C of the apparatus.

As regards the outlet channels 6*a*, which open into the outlet openings 6, these are in the illustrated embodiment designed such that they are extended in a plane parallel to the centre axis C of the apparatus but are inclined at an angle of for instance 60° to the rear end surface 1*b*, and this design contributes to maximizing contact or bearing, but also results in a tendency for the entire apparatus to rotate around the centre axis C, said tendency counteracted by connecting a stiffer piece of hose closest to the cleaning apparatus. For achieving maximum propulsion or tractive force the outlet channels 6*a* should on the other hand be made parallel to the centre axis C and extending at a right angle to the rear surface 6*c*. With regard to the area of the outlet openings 6*a* this should likewise be adapted to the flow in question in order to provide the best possible propulsion or tractive force.

While the present invention has been described in accordance with preferred compositions and embodiments, it is to be understood that certain substitutions and alterations may be made thereto without departing from the spirit and scope of the following claims.

I claim:

1. An apparatus for cleaning pipes and ducts, comprising:

a housing having a first end and a second end, the housing being a functionally integral unit;

a connection for a pressure medium disposed at the first end of the housing;

a cleaning member disposed at the second end of the housing;

a chamber defined in the housing, the chamber containing the pressure medium;

a drive member disposed inside the housing and adapted to rotate the cleaning member;

nozzle openings defined by the housing, the nozzle openings being connected with the chamber and a surface of the housing to permit the housing to propel along a duct; and a shaft having one end secured to the drive member, the shaft being rotatably disposed in the housing and adapted to carry the cleaning member at an end that is opposite to the end secured to the drive member.

2. An apparatus according to claim 1 wherein the apparatus is a turbine and the housing is a turbine housing and the drive member is a turbine rotor so that the housing surrounds the drive member.

3. An apparatus according to claim 2 wherein the drive member is a turbine wheel.

4. An apparatus according to claim 2 wherein the turbine rotor is a radial turbine rotor.

5. An apparatus according to claim 2 wherein the housing comprises a forward housing part and a rearward housing part connected to one another to prevent relative rotation of the forward housing part relative to the rearward housing part and the turbine rotor is integrally attached to the shaft.

6. An apparatus according to claim 5 wherein the nozzle openings are in fluid communication with the chamber through outlet channels defined in the housing, the nozzle openings are disposed at the rearward portion of the housing, the housing has an end surface that is substantially perpendicular to a longitudinal axis of the housing, the outlet channels extend in a direction that is parallel to the longitudinal axis.

7. An apparatus according to claim 6 wherein the outlet channels are perpendicular to the end surface of the housing.

8. An apparatus according to claim 6 wherein the outlet channels extend in a direction that is different from a 90 degree angle relative to the end surface.

9. An apparatus according to claim 1 wherein the shaft is journalled in the housing by double bearings that are axially spaced apart on the shaft.

10. An apparatus according to claim 1 wherein the turbine rotor has straight vanes.

11. An apparatus according to claim 1 wherein the housing is made from aluminum and the turbine rotor and the shaft are made of steel.

12. An apparatus according to claim 1 wherein the cleaning member is a cleaning brush.

* * * * *